US009186538B1

(12) United States Patent
Seen et al.

(10) Patent No.: US 9,186,538 B1
(45) Date of Patent: Nov. 17, 2015

(54) EXERCISE SLED AND BACKPACK COMBINATION

(71) Applicant: Grizzly Performance, LLC, Knoxville, TN (US)

(72) Inventors: Alex Douglass Seen, Knoxville, TN (US); Britton Douglass Leitch, Knoxville, TN (US)

(73) Assignee: Grizzly Performance, LLC, Knoxville, TN (US)

( * ) Notice: Subject to any disclaimer, the term of this patent is extended or adjusted under 35 U.S.C. 154(b) by 0 days.

(21) Appl. No.: 14/284,563

(22) Filed: May 22, 2014

(51) Int. Cl.
*A63B 21/00* (2006.01)
*A63B 21/065* (2006.01)

(52) U.S. Cl.
CPC ..... *A63B 21/065* (2013.01); *A63B 21/1415* (2013.01)

(58) Field of Classification Search
CPC ..... A63B 21/00
USPC ..... 482/105, 148; 280/21.1, 28.11
See application file for complete search history.

(56) References Cited

U.S. PATENT DOCUMENTS

| | | | | |
|---|---|---|---|---|
| 3,114,486 | A | 12/1963 | Flexman | |
| 3,322,425 | A | 5/1967 | Moore | |
| 4,268,917 | A | 5/1981 | Massey | |
| 4,324,409 | A * | 4/1982 | Larsen et al. | 280/14.1 |
| 4,676,502 | A | 6/1987 | Mahr | |
| 4,944,509 | A | 7/1990 | Snider | |
| 4,948,122 | A | 8/1990 | Andrews, Sr. | |
| 5,167,600 | A | 12/1992 | Baird | |
| 5,385,355 | A * | 1/1995 | Hoffman | 280/1.5 |
| 6,216,926 | B1 | 4/2001 | Pratt | |
| 6,669,608 | B1 | 12/2003 | Winston | |
| 6,675,391 | B2 | 1/2004 | Morrison | |
| 7,326,154 | B2 | 2/2008 | Foley | |
| 7,588,521 | B1 | 9/2009 | Fazzari | |
| 7,673,777 | B2 | 3/2010 | Gleason, Jr. | |
| 7,727,089 | B2 | 6/2010 | Gilman | |
| 7,972,224 | B2 | 7/2011 | Gilman | |
| 2003/0006569 | A1 * | 1/2003 | Combs | 280/21.1 |
| 2005/0051999 | A1 * | 3/2005 | Bunce et al. | 280/652 |
| 2012/0028768 | A1 | 2/2012 | McClellan Fortner | |
| 2012/0151656 | A1 | 6/2012 | Irwin | |

* cited by examiner

*Primary Examiner* — Jerome W Donnelly
(74) *Attorney, Agent, or Firm* — Luedeka Neely Group, P.C.

(57) ABSTRACT

An exercise apparatus for wearing about an upper portion of a user's body and for securing weights having a centrally-located hole extending therethrough to the body. The apparatus generally includes a frame backpack and an exercise sled to which one or more weights may be attached. The exercise sled is removably mounted to the frame backpack to operate in a first mode of operation and may be used separately from the frame backpack in a second mode of operation. In certain embodiments, the apparatus may include a connection strap for connecting the exercise sled to the frame backpack in the second mode of operation such that a user may pull the exercise sled while wearing the frame backpack.

20 Claims, 11 Drawing Sheets

EXERCISE SLED AND BACKPACK COMBINATION

FIELD

This invention relates to the field of exercise equipment. More particularly, this invention relates to a backpack adapted to receive a removable weighted exercise sled, which may be used for exercising in a weighted sled mode or in a weighted backpack mode.

BACKGROUND

Weighted vests have traditionally been used in strength training to increase the resistance level for a variety of exercises. The additional resistance increases the demand on the user's muscles and cardiovascular system, providing a more rigorous workout that results in improved strength and cardio function. The weighted vest is not only useful for traditional strength training exercises such as pushups, pull ups or squats, but may also be used during exercises that are not typically considered strength training exercises, such as walking or running.

One problem with traditional weighted vests, however, is that they often utilize several small weights that are secured at various locations around the vest. Placing the weights around the user's body in this manner may be uncomfortable or might cause the user to become unbalanced, which could lead to injury. Additionally, these weights are often non-standard weights, such as sandbags, that may only be used for the weighted vest and not for other exercises.

An alternative to pushups is the bench press. However, one problem with traditional weight lifting exercises, such as the bench press, is that the bench restricts the range of motion and may also cause injury. For example, while performing a bench press exercise, the natural movement of the user's shoulders and back are restricted by the bench itself, which could cause injury to the user.

Another exercise device that is often used to improve strength and cardiovascular health is the weighted sled. The weighted sled is typically loaded with one or more weighted plates and is designed to slide over the ground on skid surfaces. By pushing or pulling the sled, a user may build muscular and cardio strength and endurance. However, one problem with the weighted sled is that it is difficult to transport from one location to another and is difficult to store. Additionally, the type of exercises that may be performed with a weighted sled is often limited.

What is needed, therefore, is an exercise device that may be easily transported and safely used for a variety of strength and cardio exercises and that may use standardized weight plates to provide a range of resistance levels.

SUMMARY OF THE CLAIMS

The above and other needs are met by an exercise apparatus for wearing about an upper portion of a user's body and for securing weights having a centrally-located hole extending therethrough to the body. In a preferred embodiment, the exercise apparatus includes an exercise sled having one or more sled foot members, a frame backpack including one or more backpack straps, and a weight clip. The exercise sled may be removably mounted to the frame backpack to operate in a first mode of operation and may be used separately from the frame backpack in a second mode of operation. In certain embodiments, the apparatus may also include a connection strap for connecting the exercise sled to the frame backpack in the second mode of operation such that a user may pull the exercise sled along the ground surface while wearing the frame backpack.

The exercise sled includes a lower support member having an outward facing surface and an inward facing surface. The lower support member includes a body portion having two parallel tubular outer support members that are spaced apart from one another, two parallel tubular inner support members that are spaced apart from one another and that are mounted between and substantially perpendicularly to the outer support members, and a tubular central weight support member mounted between and substantially perpendicularly to the inner support members.

An upper support member is fixedly mounted to the central weight support member and extends substantially perpendicularly away from the outward facing surface of the lower support member. The upper support member includes an elongate weight spindle that is sized and configured to be inserted through a centrally-located hole of one or more standard Olympic-sized weight plates. Additionally, the apparatus may include a weight clip sized for a standard Olympic-sized weight spindle.

One or more cylindrical foot-receiving members are located on the inward facing surface of the lower support member and are fixedly mounted to the outer support members. Each of the foot-receiving members has a lower circular opening that is sized and configured to removably receive a sled foot member.

Additionally, one or more backpack-receiving members are located on the inward facing surface of the lower support member and are fixedly mounted to the inner support members. Each of the backpack-receiving members has a lower circular opening that is sized and configured to removably receive a backpack extension member, as described below.

The sled foot members each include a base member having a top surface, a bottom surface configured for sliding across a ground surface, and front and rear edges that are angled with respect to the base member. A cylindrical foot extension member is fixedly mounted to the top surface of the base member and is sized and configured to slidably engage with the one or more foot-receiving members. The foot-receiving members and the foot extension members each further comprise corresponding openings formed in their peripheral edge that permit a connection member to be inserted first through the foot-receiving member and then into the foot extension member to join the sled foot member to the foot-receiving member in concentric alignment;

The frame backpack includes two elongate outer frame members spaced apart and arranged in parallel relation to one another. The frame backpack also includes a plurality of intermediate support members rigidly interconnecting the outer frame members. These support members include one or more first intermediate frame support members located at a first end of the outer frame members, one or more second intermediate support members located at a second end of the outer frame members, and one or more third intermediate support members located between the first and second ends of the outer frame members. Additionally, one or more backpack straps are connected to the frame portion that permit a user to secure the exercise apparatus to the user's torso area. In certain embodiments, the straps are size-adjustable shoulder straps and a size-adjustable lap belt.

A plate is fixedly mounted to the intermediate support members on the outward facing surface of the lower support member. The plate is sized and configured to receive the one or more sled foot members. Additionally, one or more backpack extension members are fixedly mounted to the plate and are sized and configured to slidably engage with the backpack-receiving members. In particular, the backpack extension members and the one or more backpack-receiving members each include corresponding openings formed in their peripheral edge that permit a connection member to be inserted first through the backpack-receiving member and then into the backpack extension member to join the backpack-receiving member and the backpack extension member in concentric alignment The apparatus also includes a plurality of connection members for removably connecting together the foot-receiving members and the extension members and for removably connecting together the backpack-receiving members to the backpack extension members.

BRIEF DESCRIPTION OF THE DRAWINGS

Further advantages of various embodiments are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
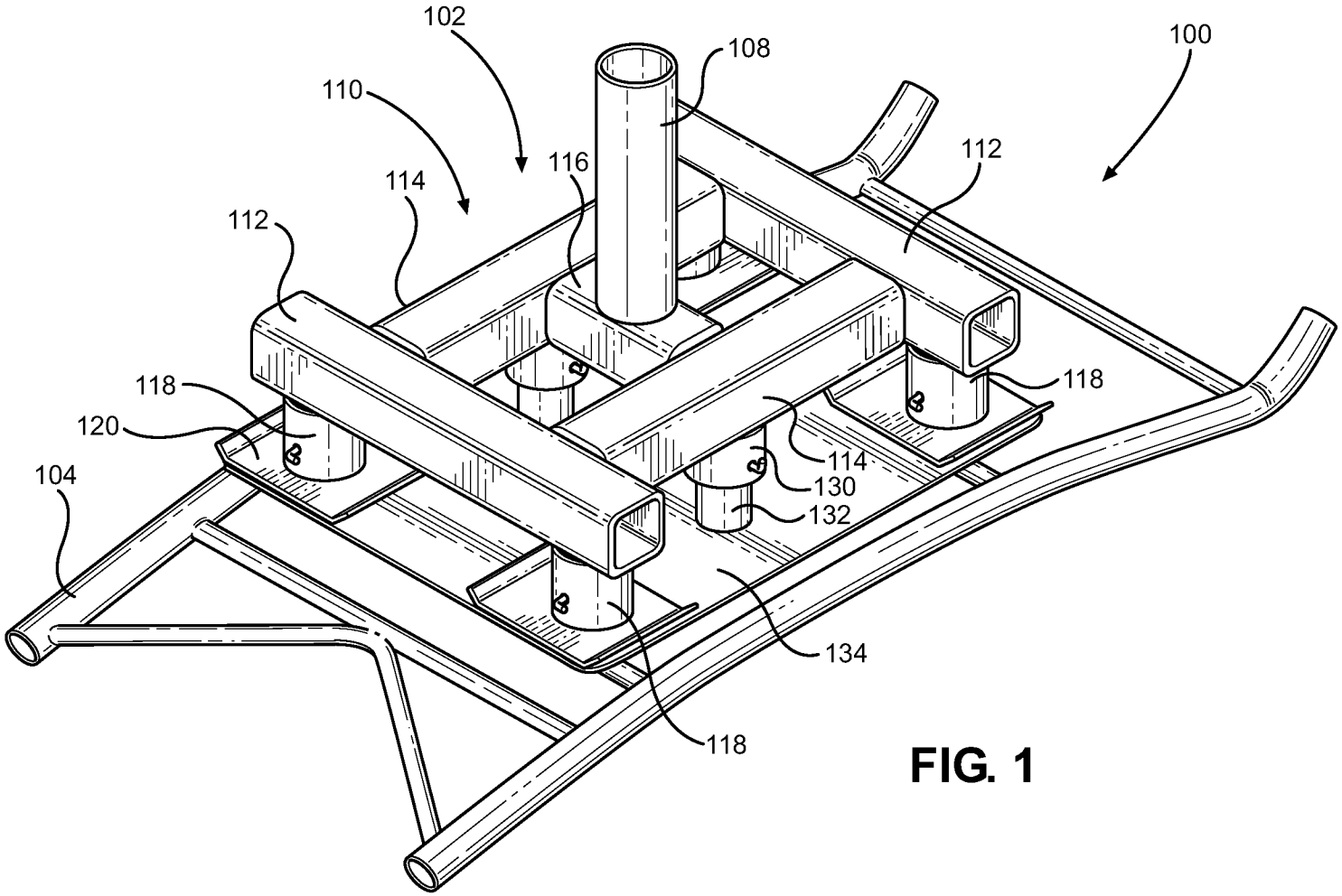
FIG. 1 is a perspective view depicting and exercise backpack and sled combination according to an embodiment of the present invention.

In the description that follows, like parts are marked throughout the specification and drawings with the same reference numerals. The drawings are not necessarily to scale and the proportions of certain parts have been exaggerated and/or shown in schematic form in the interest of clarity and conciseness. In FIGS. 2-6, sled feet 120 are shown on the leftmost side of the sled portion 102 but have been removed from the rightmost side for illustrative purposes.

With reference now to the figures and, in particular, to FIG. 1, there is provided an exercise sled and backpack apparatus 100 according to an embodiment of the present invention.

The apparatus 100 includes a sled portion 102 and a backpack portion 104. It may be appreciated that this device may be used to perform a variety of exercises in either a first configuration, where the sled is mounted to the backpack, or in a second configuration, where the sled is separate from the backpack. In the first configuration, by mounting the sled portion 102 to the backpack portion 104, the apparatus 100 provides for exercises such as weighted pushups or squats to be performed. On the other hand, in the second configuration, the sled portion 102 is separate from the backpack portion 104. In this configuration, the apparatus 100 can be used in pushing, pulling or running-type exercises. In either configuration, weights may be added to or removed from the sled to vary the resistance level.

Sled

Figure 2:
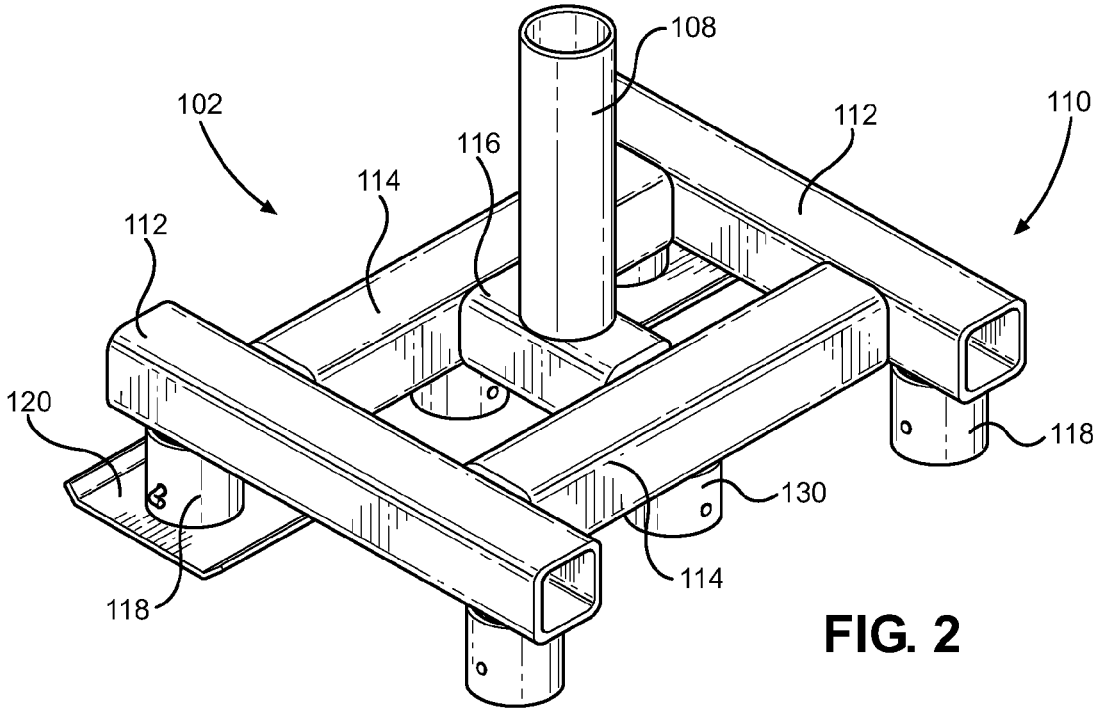
FIG. 2 is a perspective view depicting the sled shown in FIG. 1 with the rightmost sled feet removed.
Figure 3:
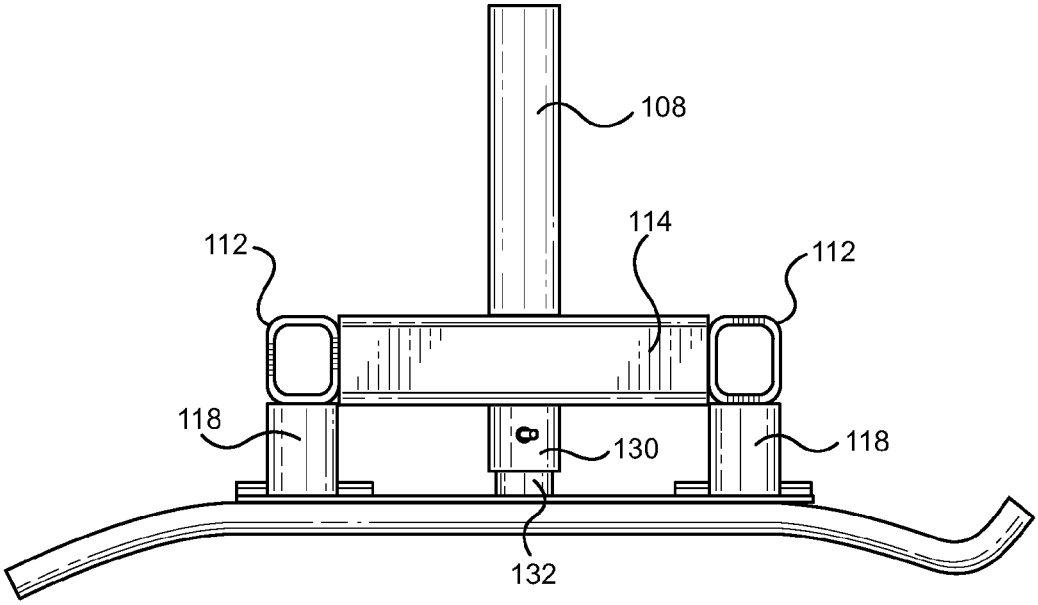
FIG. 3 is a side elevation view of the sled shown in FIG. 2 including the backpack portion.
Figure 4:
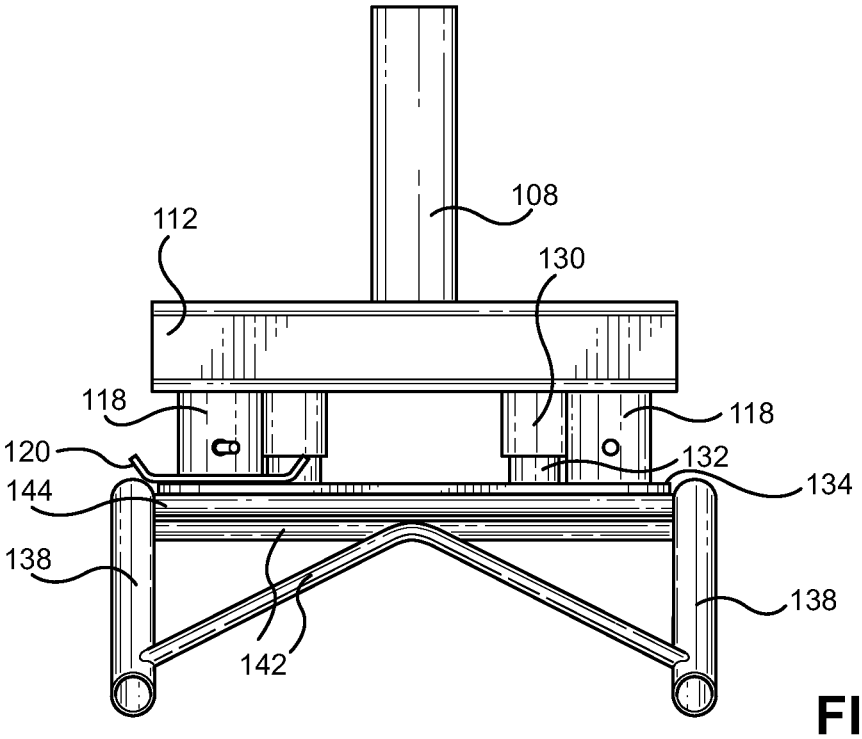
FIG. 4 is a front elevation view of the sled shown in FIG. 3.
Figure 5:
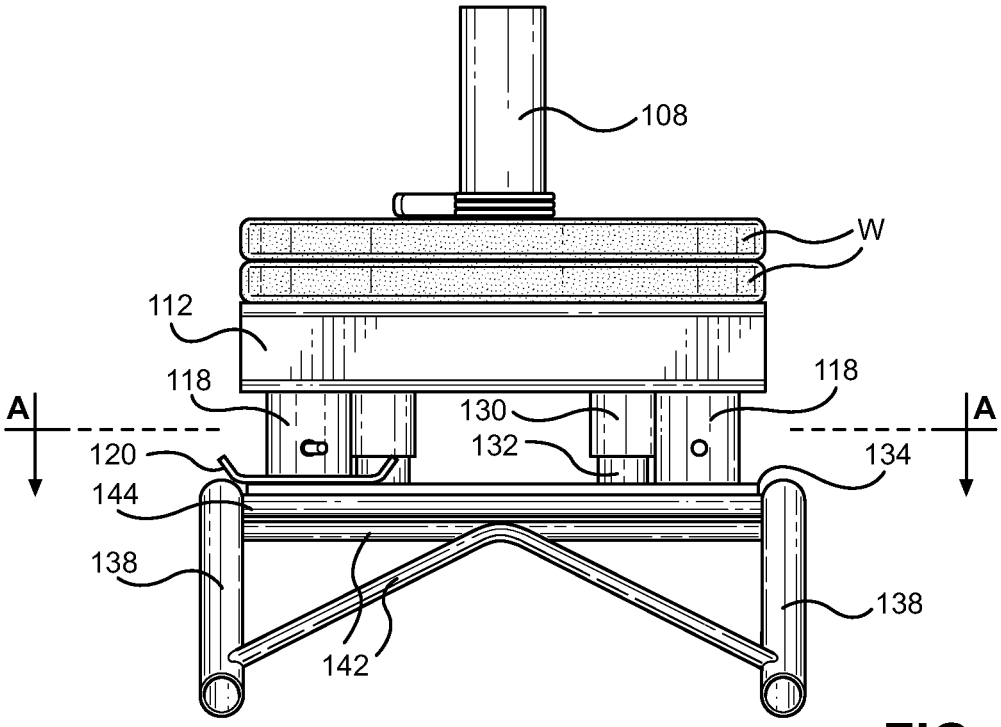
FIG. 5 is a front elevation view of the sled shown in FIG. 3 with two weighted plates placed on the spindle.

As shown in FIGS. 2-4, the sled portion, which is preferably substantially made of a rigid material such as a steel or aluminum, includes an upper support member 108 that is mounted to a lower support member 110. In certain embodiments, the upper support member 108 is mounted to a frame portion of the lower support member 110. In particular, the lower support member 110 has an outward facing surface and an inward facing surface. As described in greater detail below, the upper support member 108 is preferably mounted to the outward facing surface of the lower support member 110.

The inward facing surface is disposed towards the user in the first (i.e., backpack) configuration and towards the ground in the second (i.e., sled) configuration. On the other hand, the outward facing surface is disposed away from the user in the first configuration and away from the ground in the second configuration.

In certain embodiments, the frame may include a body portion having two parallel tubular outer support members 112 that are spaced apart from one another, two parallel tubular inner support members 114 that are spaced apart from one another and that are mounted between and are oriented substantially perpendicularly to the outer support members, and a tubular central weight support member 116 that is mounted between and is oriented substantially perpendicularly to the inner support members.

The apparatus 100 may further include an upper support member 108 disposed adjacent the outward facing surface of the lower support member 110, particularly on the central weight support member 116. The upper support member 108 is operable for receiving one or more weights. Preferably, the upper support member 108 is a spindle-type connection member that is suited for holding multiple weights of varying sizes. This enables the use of a range of weights to accommodate a range of abilities and strengths. In certain embodiments, the upper support member 108 is sized and configured for use in connection with Olympic standard sized weights. This enables the apparatus 100 to be used with standard weights that are found in most gyms so that purchasing specially designed weights is unnecessary.

The upper support member 108 is preferably located such that it may be inserted through a centrally-located hole of the weights and such that, when the backpack 104 and the sled 102 are joined and are placed on the back of a user, the weights are located at the user's upper back area and are substantially between the user's shoulder blades. Unlike other devices, where weights may be distributed around the upper torso area, by locating the weights primarily over the central portion of the user's back, the user is able to remain balanced more easily and the chance of injury is reduced. This is most clearly illustrated in FIGS. 11, 12A and 12B.

In certain preferred embodiments, the upper support member 108 may be removed from the sled 102. For example, the upper support member 108 may include a threaded connection, such as a bolt, that joins to a corresponding threaded connection located in the central weight support member 116. One benefit offered by a removable upper support member 108 is that the apparatus 100 would be easier to transport and to store.

The sled portion 102 further includes a sled surface 120 that is operable for sliding over a ground surface. The sled surface 120 also referred to herein as a skid, is located on the lower surface of the exercise sled 102. When the sled portion 102 is used separately from the backpack 104 as an exercise sled, the sled surface 120 contacts the ground.

It may be appreciated that different ground surfaces may have different surface characteristics. Accordingly, sled 102 may be provided with sled surfaces 120 that are suited for different surfaces. For example, if the sled 102 is used on grass, a first sled surface may be suitable. On the other hand, if the sled 102 is used on sand, a second sled surface 120 may be suitable. Additionally, it may be appreciated that the sled surface 120 may degrade over time due to use, weathering, etc. Accordingly, replacement sled surfaces 120 may be provided.

In certain embodiments, as shown in FIG. 1, the sled surface 120 comprises multiple separate sled foot members. While four separate skids 120 are pictured, more or fewer skids may be used. For example, one skid 120 may be sized to traverse the entire length or width of the lower support member 110 such that only two separate skids would be necessary. Alternatively, one skid 120 may be provided as a single unit that is sized to cover the entire bottom surface of the lower support member 110.

The lower support member 110 also includes one or more foot-receiving members 118 that are fixedly mounted to the outer support members 112 and extend away from the inward facing surface. The cylindrical foot-receiving members 118 each include lower circular openings and are each sized and configured to removably receive a skid or foot member 120.

Figure 6A:
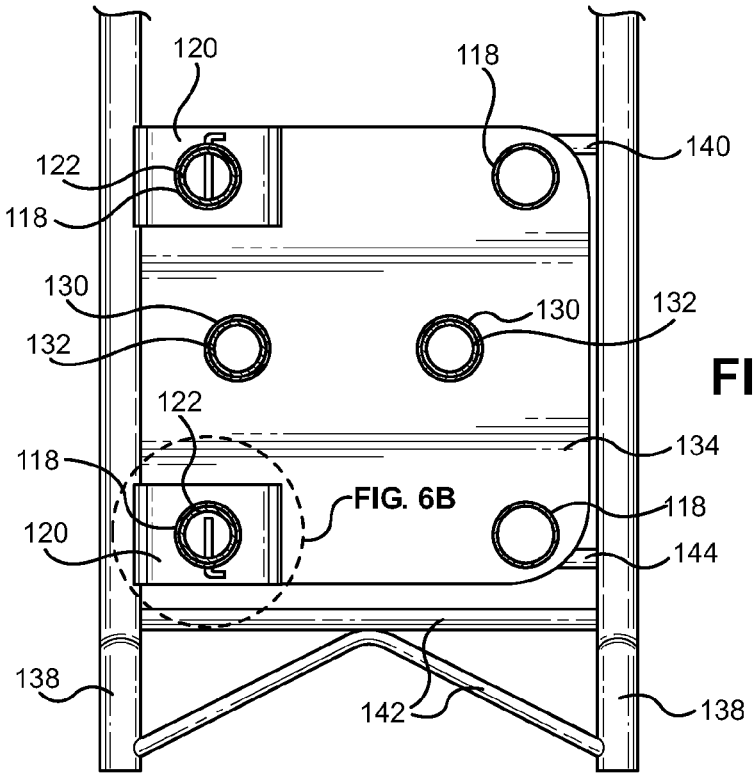
FIG. 6A is a top-down sectional view of the backpack portion shown along line A-A.
Figure 6B:
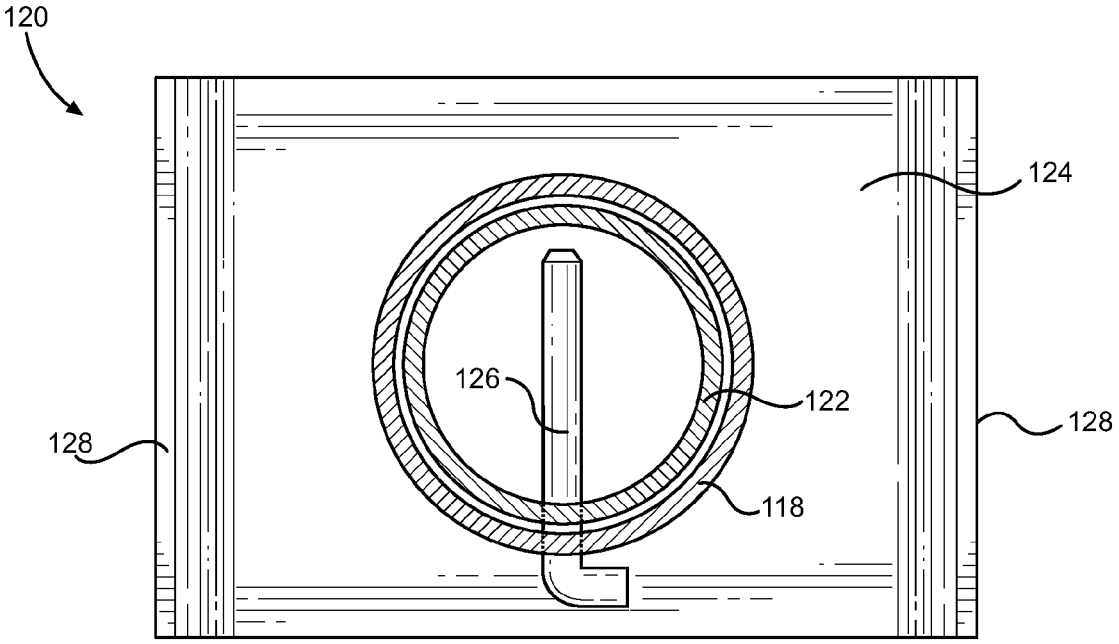
FIG. 6B is a top-down detail view of the skid foot shown in FIG. 6A.

The skids 120 include an extension member 122 that is fixedly mounted to a base member 124. As shown in FIGS. 6A and 6B, the cylindrical extension member 122 is sized to slidably engage with the foot-receiving member 118. Additionally, a connection member 126, such as a pin or other similar threaded connector, may be inserted through openings to join the skid 120 to the foot-receiving member 118 in axial alignment. Alternatively, the extension member 122 and the foot-receiving member 118 may include corresponding threaded members suited to provide a threaded connection.

Figure 7A:
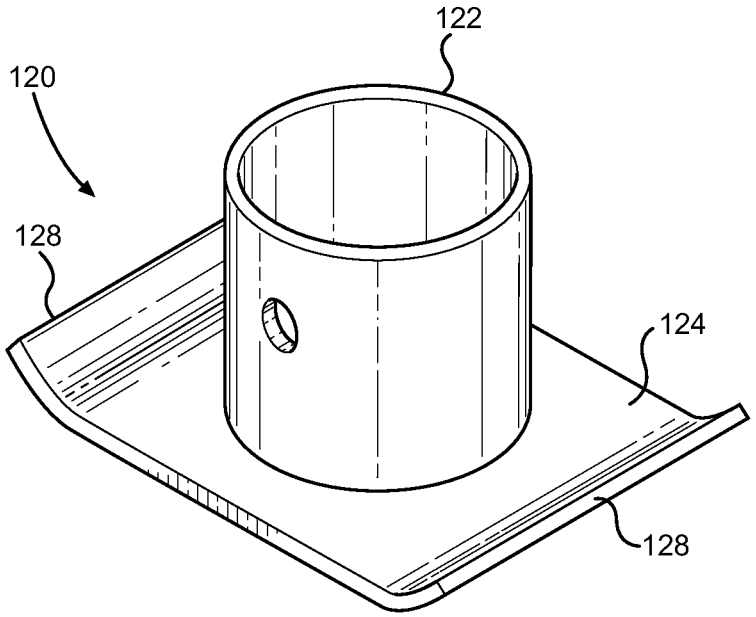
FIG. 7A is a perspective view depicting a skid foot according to one embodiment of the present invention.
Figure 7B:
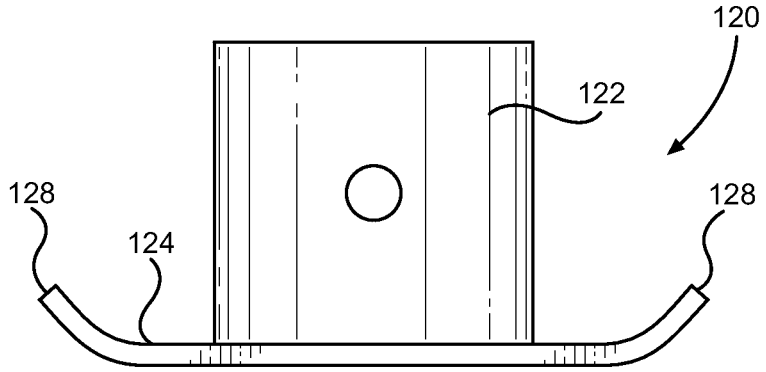
FIG. 7B is a side elevation view of the skid foot shown in FIG. 7A.

As shown best in FIGS. 7A and 7B, the base member 124 of the skid 120 is configured to make contact with the ground when the apparatus 100 is used in the sled mode. In the backpack mode, the base member 124 of the skids 120 is configured to contact a mounting plate 134 (FIG. 1). In certain embodiments, the base member 124 includes front and rear edges 128 that are angled with respect to the bottom member. The edges 128 are preferably angled to enable the skid to traverse the ground or flooring surface more easily when the sled 102 is in motion. Preferably, the skids 120 are removable from the lower support member 110 and may be exchanged or replaced. For example, skids 120 may be replaced if they become worn or damaged.

Additionally, skids 120 may be provided with bottom members 124 formed with different materials that are more advantageous in different situations or that provide different travel characteristics. For example, one skid 120 may include a bottom member 124 that is suitable for indoor use over flooring or carpeting and another skid may be more suitable for outdoor use over sand or grass.

Referring again to FIG. 1, the lower support member 110 also includes one or more backpack-receiving members 130 that enable the backpack portion 104 and the sled portion 102 to be securely connected together. The cylindrical backpack-receiving members 130 may be disposed on the inner support members 114 extending substantially perpendicularly away from the inward facing surface and sized and configured to removably receive one or more backpack extension members 132. The backpack extension members 132 are preferably fixedly mounted to the plate 134 and are sized to slidably engage with the backpack-receiving members 130. Additionally, a connection member 126, such as a pin or other similar threaded connector, may be inserted through openings to join the backpack-receiving members 130 to the backpack extension members 132 in axial alignment. Alternatively, the backpack-receiving members 130 and the backpack extension members 132 may include corresponding threaded portions suited to provide a threaded connection.

Figure 8:
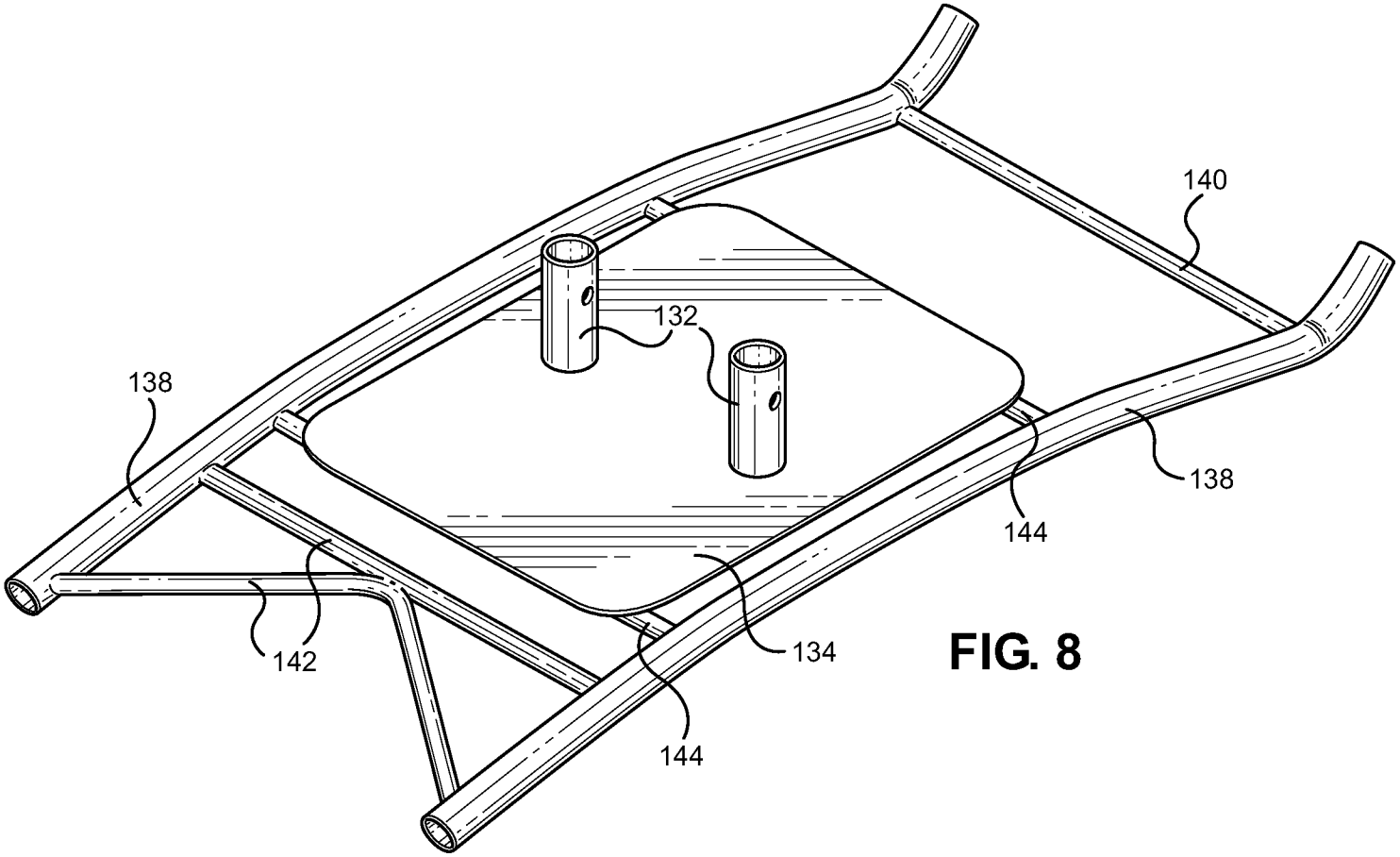
FIG. 8 is a perspective of of the backpack portion shown in FIG. 1.
Figure 9:
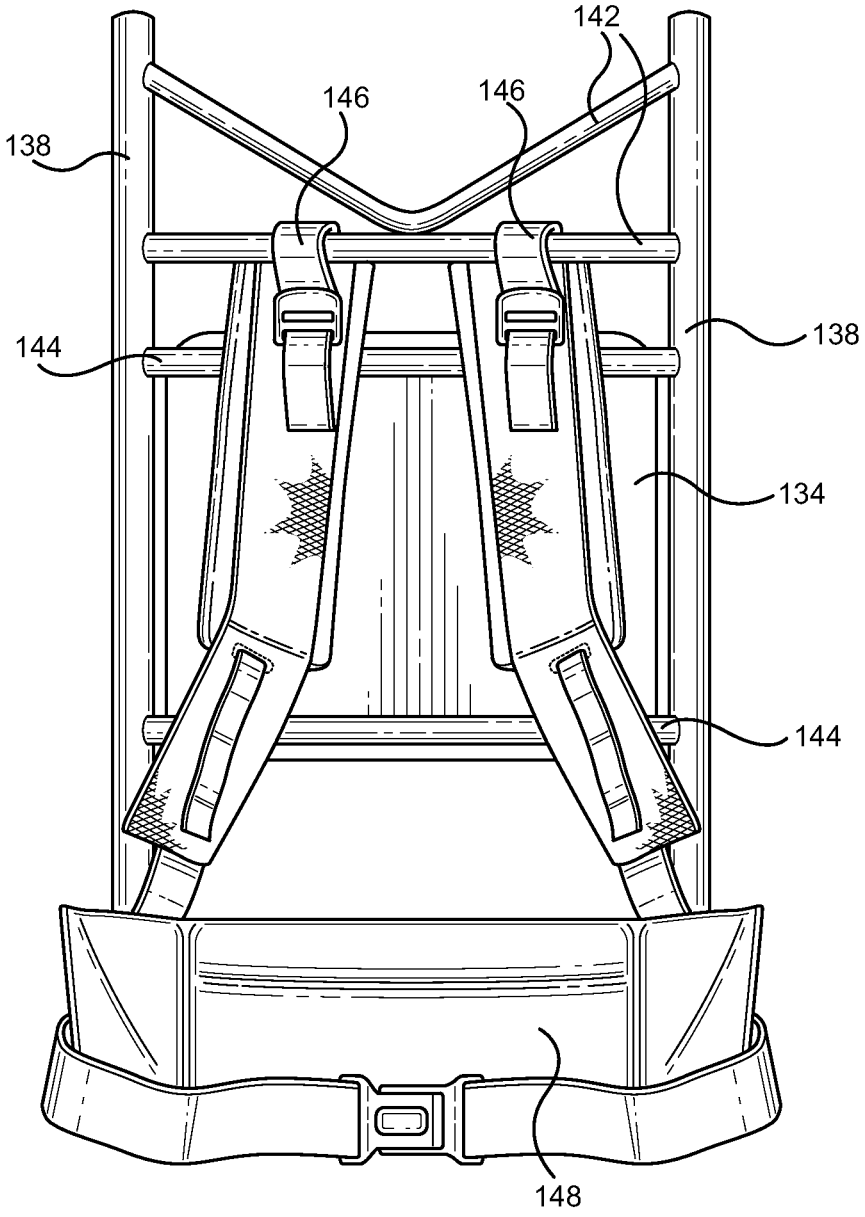
FIG. 9 depicts an inner surface of the backpack portion including attachment straps.
Figure 10:
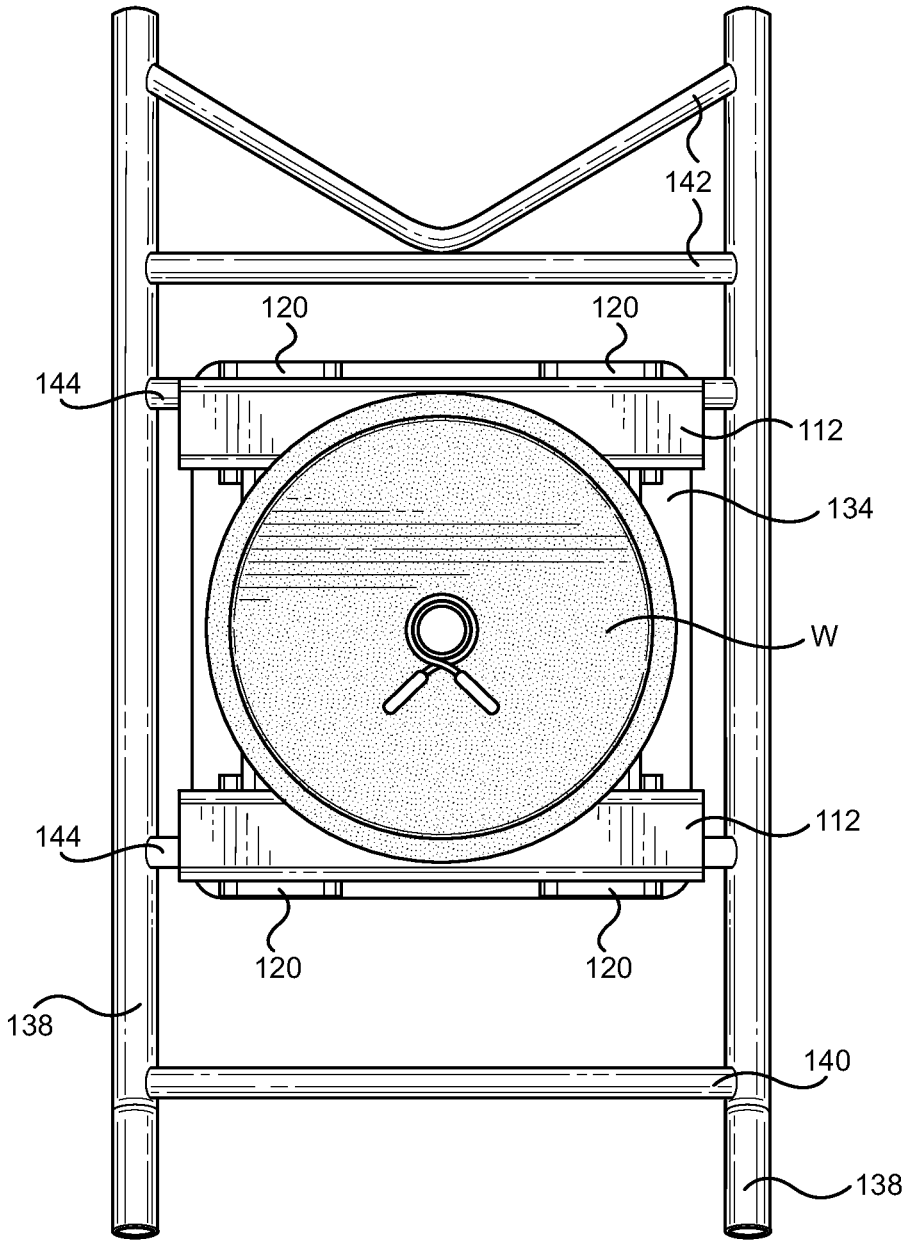
FIG. 10 depicts an exercise backpack and sled combination according to an embodiment of the present invention with two weighted plates placed on the spindle.

With reference to FIG. 8, the plate 134 is fixedly mounted to an all-purpose lightweight individual carrying equipment (ALICE)-type backpack frame. The frame consists of two elongate outer frame members 138 that are spaced apart in parallel relation to one another. A plurality of intermediate frame support members is fixedly mounted between the outer frame members 138. For example, one or more first intermediate frame support members 140 are disposed at a first end of the outer frame members 138, one or more second intermediate support members 142 are disposed at a second end of the outer frame members, and one or more third intermediate support members 144 are disposed between the first and second ends of the outer frame members and provide support to the plate 134. As shown in FIG. 9, the frame preferably includes size-adjustable strap members 146 that enable a user to place the backpack portion on their back. Each strap member 146 is connected between two or more intermediate support members. In certain embodiments, a size-adjustable lap belt 148 may also be provided.

Figure 11:
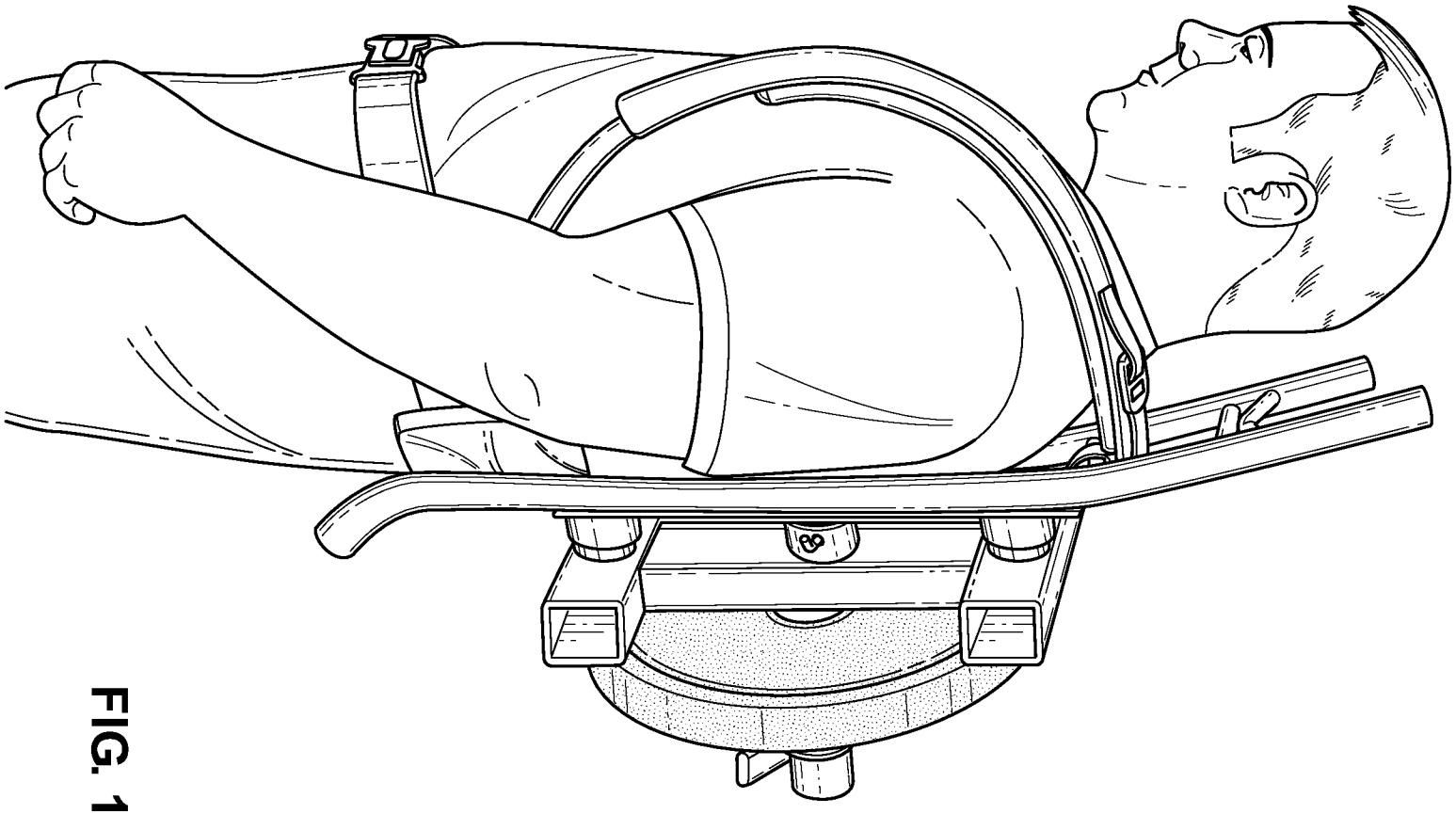
FIG. 11 depicts a user wearing an exercise backpack and sled combination.
Figure 12A:
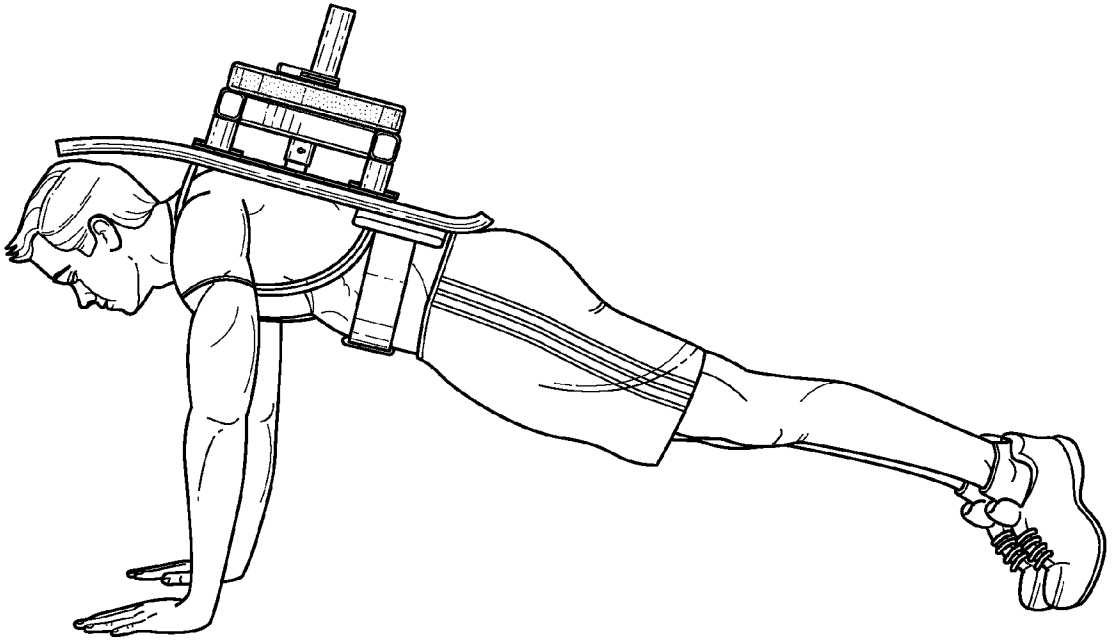
FIGS. 12A and 12B depict a user performing a pushup while wearing an exercise backpack and sled combination.
Figure 12B:
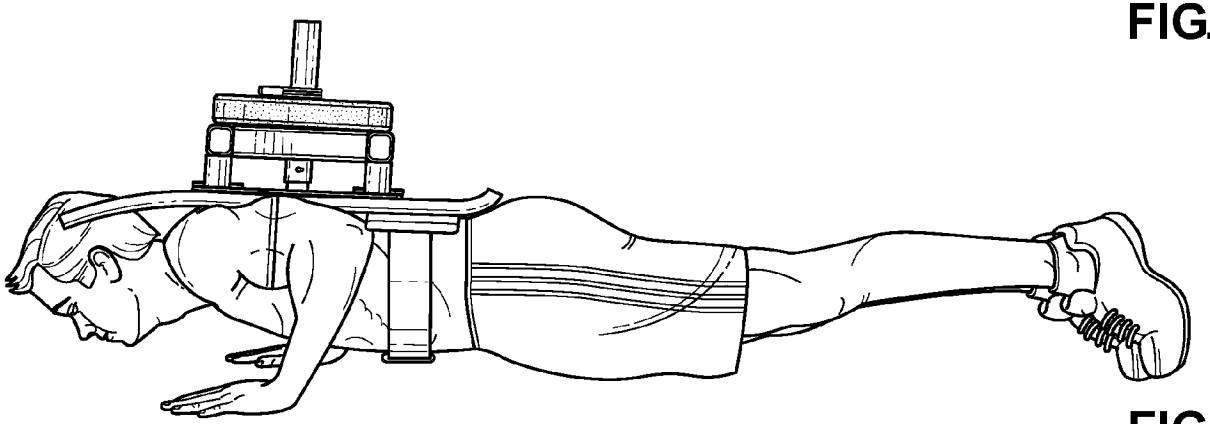

This device may be used to perform a variety of exercises while functioning as a weighted sled or as a weighted backpack. As shown in FIGS. 11, 12A and 12B, while functioning as a weighted backpack, exercises such as weighted pushups or squats may be performed. One benefit of this apparatus when compared to traditional exercise apparatus, such as a bench press, is that action is a natural movement that reduces the chance for injury while improving functional performance. Additionally, concentrating the weights between the shoulders reduces the chance of injury, such as a lower back injury.

Figure 13:
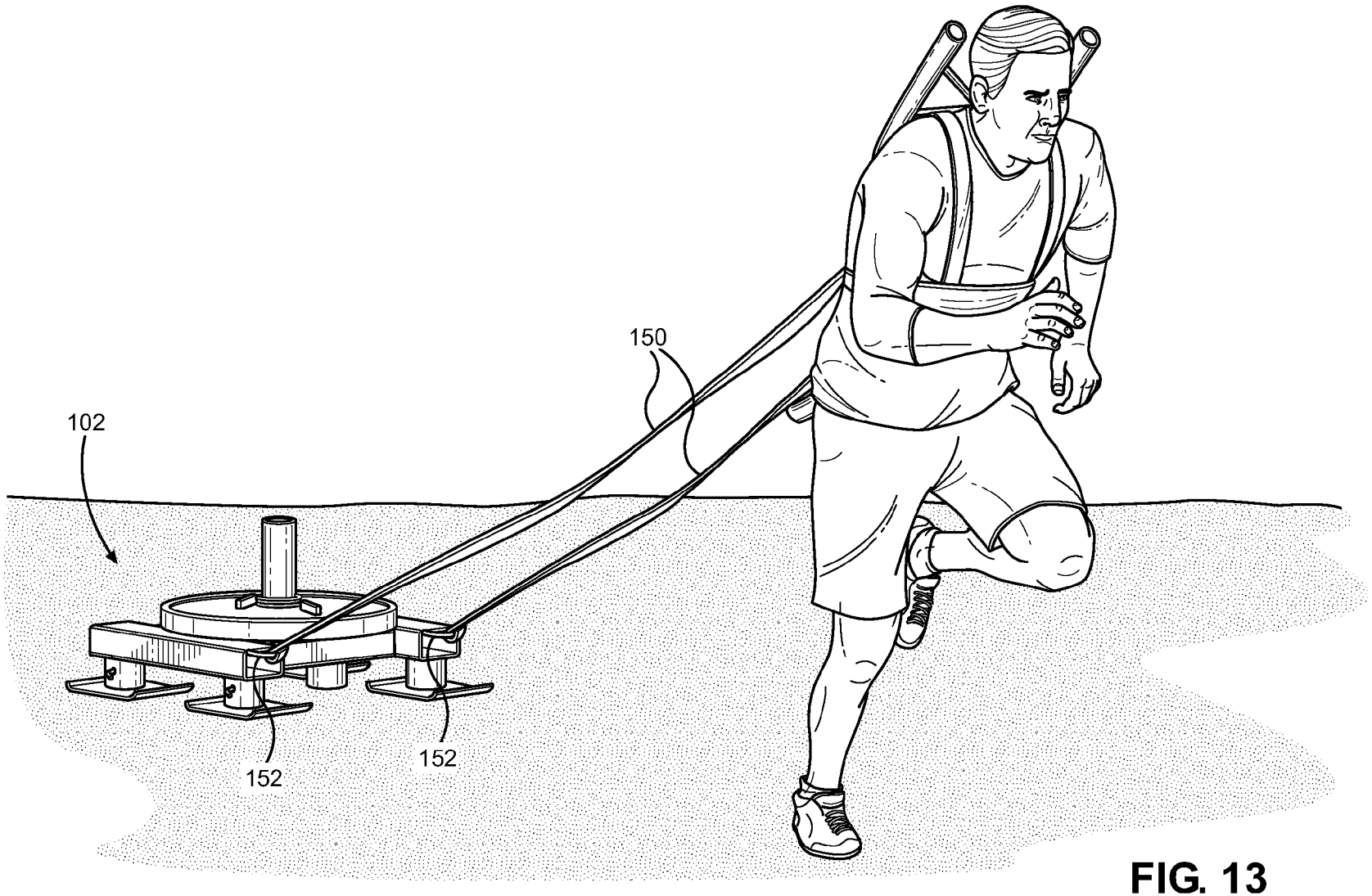
FIG. 13 depicts a user running while wearing the backpack attached to the sled portion by straps.

The apparatus may also be used in the sled configuration to perform pushing, pulling or running-type exercises. For example, as illustrated in FIG. 13, the sled portion 102 may first be removed from the backpack portion 104, placed onto the ground, and then connected to the backpack portion via straps 150. These straps 150 may be attached to the sled 104 at connection hooks 152.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An exercise apparatus comprising:

an exercise sled having an upper surface and a lower surface, a sled surface operable for sliding over a ground surface disposed on the lower surface of the exercise sled, an upper support member disposed on the upper surface of the exercise sled operable for receiving one or more weights, and a first backpack connection member operable for removably mounting the exercise sled to an outer surface of a frame backpack disposed on the lower surface of the exercise sled; and a frame backpack having an outer surface and an inner surface, a second backpack connection member disposed on the outer surface of the frame backpack and operable for connecting to the first backpack connection member, one or more backpack straps connected to the frame backpack that permit a user to secure the exercise apparatus to an upper portion of the user's body;

wherein the exercise sled is removably mounted to the frame backpack to operate in a first mode of operation and wherein the exercise sled may be used separately from the frame backpack in a second mode of operation.

2. The exercise apparatus of claim 1 wherein the frame backpack further comprises:

two elongate outer frame members spaced apart and arranged in parallel relation to one another;

a plurality of intermediate support members rigidly interconnecting the outer frame members including one or more first intermediate frame support members disposed at a first end of the outer frame members, one or more second intermediate support members disposed at a second end of the outer frame members, and one or more third intermediate support members disposed between the first and second ends of the outer frame members;

a plate fixedly mounted to the one or more third intermediate support members and disposed on the outer surface of the frame backpack;

the first backpack connection member comprising one or more backpack-receiving members;

the second backpack connection comprising one or more backpack extension members fixedly mounted to the plate and sized and configured to slidably engage with the one or more backpack-receiving members;

the one or more backpack extension members and the one or more backpack-receiving members each further comprising corresponding openings that permit a connection member to be inserted first through the backpack-receiving member and then into the backpack extension member to join the backpack-receiving member and the backpack extension member in concentric alignment;

the sled surface comprising one or more foot-receiving members disposed on the lower surface of the sled and corresponding sled foot members, wherein the one or more foot-receiving members are configured to removably receive the sled foot members; and a plurality of connection members for removably connecting together the one or more foot-receiving members and the sled foot members and for removably connecting together the backpack-receiving members to the backpack extension members.

3. The exercise apparatus of claim 1 further comprising:

the sled surface comprising one or more sled feet, each sled foot comprising:

a base member having a top surface, a bottom surface configured for sliding across a ground surface, and front and rear edges that are angled with respect to the base member; and a foot extension member fixedly mounted to the top surface of the base member; and the exercise sled further comprising one or more foot-receiving members disposed on the lower surface of the sled, each of the one or more foot-receiving members having a lower opening that is sized and configured to receive a foot extension member.

4. The exercise apparatus of claim 3 wherein the foot-receiving members and the foot extension members are cylindrical in shape and each further comprises corresponding openings that permit a connection member to be inserted first through the foot-receiving member and then into the foot extension member to join the sled foot to the foot-receiving member in concentric alignment.

5. The exercise apparatus of claim 1 wherein the weight connection member comprises an elongate weight spindle that is sized and configured to be inserted through a portion of one or more weights.

6. The exercise apparatus of claim 5 wherein the spindle is sized and configured to be inserted through a centrally-located hole of one or more standard Olympic-sized weight plates.

7. The exercise apparatus of claim 1 wherein the upper support member is removable from the exercise sled.

8. The exercise apparatus of claim 1 further comprising a connection strap operable for connecting the exercise sled to the frame backpack in the second mode of operation such that a user may pull the exercise sled while wearing the frame backpack.

9. The exercise apparatus of claim 1 wherein the one or more backpack straps comprise two size-adjustable shoulder straps and a size-adjustable lap belt.

10. An exercise apparatus comprising:

an exercise sled comprising a body portion having an inward facing surface and an outward facing surface, an upper support member disposed on the outward facing surface configured for insertion through a portion of one or more weights to secure the weights to the exercise sled, a first backpack connection member disposed on the inward facing surface, and one or more sled feet comprising a bottom surface disposed on the inward facing surface, the bottom surface configured for sliding across a ground surface; and a frame backpack comprising a frame portion having an outer surface and an inner surface, a second backpack connection member fixedly mounted to the frame portion and disposed on the outer surface of the frame backpack, the second backpack connection member operable for connecting to the first backpack connection member, one or more backpack straps connected to the frame portion that permit a user to secure the exercise apparatus to an upper portion of the user's body;

wherein the exercise sled is removably mounted to the frame backpack to operate in a first mode of operation and wherein the exercise sled may be used separately from the frame backpack in a second mode of operation; and wherein, in the first mode of operation, the weights are disposed at the user's upper back area and substantially between the user's shoulder blades.

11. The exercise apparatus of claim 10 wherein the frame backpack further comprises:

two elongate outer frame members spaced apart and arranged in parallel relation to one another;

a plurality of intermediate support members rigidly interconnecting the outer frame members including one or more first intermediate frame support members disposed at a first end of the outer frame members, one or more second intermediate support members disposed at a second end of the outer frame members, and one or more third intermediate support members disposed between the first and second ends of the outer frame members;

a plate fixedly mounted to the one or more third intermediate support members and disposed on the outer surface of the frame backpack; and the first backpack connection member comprising one or more backpack-receiving members the second backpack connection comprising one or more backpack extension members fixedly mounted to the plate and sized and configured to slidably engage with the one or more backpack-receiving members;

the one or more backpack extension members and the one or more backpack-receiving members each further comprising corresponding openings that permit a connection member to be inserted first through the backpack-receiving member and then into the backpack extension member to join the backpack-receiving member and the backpack extension member in concentric alignment; and a plurality of connection members for removably connecting together the foot-receiving members and the extension members and for removably connecting together the backpack-receiving members to the backpack extension members.

12. The exercise apparatus of claim 10 wherein the sled surface comprises one or more sled feet, each sled foot comprising:

a base member having a top surface, a bottom surface configured for sliding across a ground surface, and front and rear edges that are angled with respect to the base member; and a foot extension member fixedly mounted to the top surface of the base member; and wherein the sled further comprises one or more foot-receiving members disposed on the lower surface of the sled, each of the one or more foot-receiving members having a lower opening that is sized and configured to receive a foot extension member.

13. The exercise apparatus of claim 12 wherein the foot-receiving members and the foot extension members are cylindrical in shape and each further comprise corresponding openings that permit a connection member to be inserted first through the foot-receiving member and then into the foot extension member to join the sled foot to the foot-receiving member in concentric alignment.

14. The exercise apparatus of claim 10 wherein the upper support member comprises an elongate weight spindle that is sized and configured to be inserted through a centrally-located hole of one or more standard Olympic-sized weight plates.

15. The exercise apparatus of claim 10 wherein the upper support member is removable from the exercise sled.

16. The exercise apparatus of claim 10 further comprising a connection strap operable for connecting the exercise sled to the frame backpack in the second mode of operation such that a user may pull the exercise sled while wearing the frame backpack.

17. The exercise apparatus of claim 10 wherein the one or more backpack straps comprise two size-adjustable shoulder straps and a size-adjustable lap belt.

18. An exercise apparatus for wearing about an upper portion of a user's body and for securing weights having a centrally-located hole extending therethrough to the body, the exercise apparatus comprising:

an exercise sled comprising:

a lower support member having an outward facing surface and an inward facing surface and comprising a body portion having two parallel tubular outer support members that are spaced apart from one another, two parallel tubular inner support members that are spaced apart from one another and that are mounted between and substantially perpendicularly to the outer support members, and a tubular central weight support member mounted between and substantially perpendicularly to the inner support members;

an upper support member fixedly mounted to the central weight support member and extending substantially perpendicularly away from the outward facing surface of the lower support member, the upper support member comprising an elongate weight spindle that is sized and configured to be inserted through a centrally-located hole of one or more standard Olympic-sized weight plates;

one or more cylindrical foot-receiving members disposed on the inward facing surface of the lower support member and fixedly mounted to the outer support members, each of the one or more foot-receiving members having a lower circular opening that is sized and configured to removably receive a portion of a sled foot member; and one or more cylindrical backpack-receiving members disposed on the inward facing surface of the lower support member and fixedly mounted to the inner support members, each of the one or more backpack-receiving members having a lower circular opening that is sized and configured to removably receive a backpack extension member;

one or more sled foot members, each foot member comprising:

a base member having a top surface, a bottom surface configured for sliding across a ground surface, and front and rear edges that are angled with respect to the base member; and a cylindrical foot extension member fixedly mounted to the top surface of the base member and sized and configured to slidably engage with the one or more foot-receiving members, wherein the foot-receiving members and the foot extension members each further comprise corresponding openings that permit a connection member to be inserted first through the foot-receiving member and then into the foot extension member to join the sled foot member to the foot-receiving member in concentric alignment;

a frame backpack comprising:

two elongate outer frame members spaced apart and arranged in parallel relation to one another, a plurality of intermediate support members rigidly interconnecting the outer frame members including one or more first intermediate frame support members disposed at a first end of the outer frame members, one or more second intermediate support members disposed at a second end of the outer frame members, and one or more third intermediate support members disposed between the first and second ends of the outer frame members;

a plate fixedly mounted to the one or more third intermediate support members and disposed on the outward facing surface of the lower support member, the plate sized and configured to receive the one or more sled foot members;

one or more backpack extension members fixedly mounted to the plate and sized and configured to slidably engage with the backpack-receiving members, wherein the one or more backpack extension members and the one or more backpack-receiving members each further comprise corresponding openings that permit a connection member to be inserted first through the backpack-receiving member and then into the backpack extension member to join the backpack-receiving member and the backpack extension member in concentric alignment;

a plurality of connection members for removably connecting together the foot-receiving members and the extension members and for removably connecting together the backpack-receiving members to the backpack extension members; and one or more backpack straps connected to the frame portion that permit a user to secure the exercise apparatus to an upper portion of the user's body;

a weight clip sized for a standard Olympic-sized weight spindle;

wherein the exercise sled is removably mounted to the frame backpack to operate in a first mode of operation and wherein the exercise sled may be used separately from the frame backpack in a second mode of operation.

19. The exercise apparatus of claim 18 further comprising a connection strap operable for connecting the exercise sled to the frame backpack in the second mode of operation such that a user may pull the exercise sled while wearing the frame backpack.

20. The exercise apparatus of claim 18 wherein the one or more backpack straps comprise two size-adjustable shoulder straps and a size-adjustable lap belt.

* * * * *